US006068918A

United States Patent [19]

Van Der Veer et al.

[11] Patent Number: 6,068,918

[45] Date of Patent: May 30, 2000

[54] STEEL CORD TREATED WITH A CORROSION INHIBITING COMPOSITION

[75] Inventors: Jan Marcel Van Der Veer, Uithoorn; Hendrik Laurens Mulder, Mijdrecht; Gerardus Johannes Joseph Streefland, Utrecht, all of Netherlands; Johan Vanbrabant, Zwevegem; Frank Deruyck, Nazareth, both of Belgium

[73] Assignee: N.V. Bekhaert S.A., Belgium

[21] Appl. No.: 08/949,373

[22] Filed: Oct. 14, 1997

[30] Foreign Application Priority Data

Oct. 15, 1996 [EP] European Pat. Off. ..... 96202780

[51] Int. Cl.[7] ..... B32B 15/00; B32B 15/08

[52] U.S. Cl. ..... 428/379; 428/383; 428/381; 428/388; 428/389

[58] Field of Search ..... 428/379, 381, 428/383, 388, 389

[56] References Cited

U.S. PATENT DOCUMENTS

| | | |
|---|---|---|
| 2,634,237 | 4/1953 | Kopf . |
| 2,890,170 | 6/1959 | Ragborg . |
| 3,526,596 | 9/1970 | Kress . |
| 3,681,440 | 8/1972 | Gash . |
| 4,169,112 | 9/1979 | Elmer et al. . |
| 4,178,261 | 12/1979 | Dhein et al. . |
| 4,404,828 | 9/1983 | Blachford . |
| 4,618,539 | 10/1986 | Jahnke et al. . |
| 4,786,427 | 11/1988 | Dare-Edwards . |
| 4,871,476 | 10/1989 | Yoshimura et al. . |
| 4,978,468 | 12/1990 | Yoshimura et al. . |
| 5,023,016 | 6/1991 | Gallacher et al. . |
| 5,104,558 | 4/1992 | Matsuzaki . |
| 5,118,367 | 6/1992 | Starinshak . |
| 5,156,759 | 10/1992 | Culpon, Jr. . |
| 5,229,215 | 7/1993 | Starinshak . |
| 5,243,047 | 9/1993 | Lawson . |

FOREIGN PATENT DOCUMENTS

| | | |
|---|---|---|
| 1426943 | 5/1966 | France . |
| 118668 | 3/1976 | Germany . |
| 2704190 | 8/1978 | Germany . |
| 002027897 | 5/1974 | Japan . |
| 2227304 | 10/1990 | Japan . |
| 03017191 | 1/1991 | Japan . |
| 002027898 | 11/1979 | Romania . |
| 002027896 | 3/1994 | Russian Federation . |
| 742468 | 12/1955 | United Kingdom . |
| 1177873 | 1/1970 | United Kingdom . |
| 1364781 | 8/1974 | United Kingdom . |

OTHER PUBLICATIONS

I.M. Notter, M.E. Warwick and D.R. Gabe, "Electrochemical measurement on the porosity of tin coatings on steel", 1996, pp. 105–109.

I.M. Notter and D.R. Gabe, Porosity of Electrodeposited Coatings: Its Cause, Nature Effect and Management, vol. 10, Nos. 3–4, 1992, pp. 217–249.

*Primary Examiner*—William Krynski
*Assistant Examiner*—J. M. Gray
*Attorney, Agent, or Firm*—Webb Ziesenheim Logsdon Orkin & Hanson, P.C.

[57] ABSTRACT

A corrosion inhibiting composition containing a carrier of an oily or waxy type together with active components including at least one corrosion-inhibitor of the azole-type and a co-corrosion-inhibitor, together with optional water repellants or certain alcohols alone or in admixture. The compositions are suitable for protecting from corrosion steel wire or steel cord composed of several steel filaments.

23 Claims, 1 Drawing Sheet

STEEL CORD TREATED WITH A CORROSION INHIBITING COMPOSITION

BACKGROUND OF THE INVENTION

1. Area of the Invention

The invention relates to steelcord, covered with a coating of a material having an electrode potential, exceeding the electrode potential of steel or having a rate of corrosion, which is less than the rate of corrosion of steel, treated with a corrosion inhibiting composition according to the invention. Another object of the invention is a process for treating steel cord with the corrosion inhibiting composition according to the invention. A further object of the invention relates to rubber articles containing steel cord, treated with a corrosion inhibiting composition according to the invention.

2. Description of the Prior Art

Corrosion inhibiting compositions, typically in the form of solutions, suspensions or emulsions are commonly employed in the metal working industry to provide improved corrosion resistance of the metal objects involved. An example of such metal objects is steel cord, which is applied in rubber articles as metal reinforcement. Corrosion of steel cord may occur in the manufacturing process, during storage and transport of the steel cord as well as during and after the application of the steel cord in the rubber articles. In this respect it is remarked that always a certain amount of moisture is present in rubber articles whereas additional moisture may penetrate the rubber articles by way of diffusion and in particular by way of hair cracks and other imperfections.

In the prior art many corrosion inhibiting compositions have been used. For instance, in DE-A 2,704,190 a method is disclosed for improving the corrosion resistance of steel cord coated with a Zr, brass or bronze layer by dipping it just long enough in a sodium nitrite or potassium nitrite solution for moistening to occur and then drying it at a temperature below 150° C.

Another method for providing corrosion protection to steel cord to be embedded in rubber articles like tires is disclosed in JP 02227304 A2. According to this document the tires have interior layers containing water-absorbing polymers and exterior layers of halobutyl rubbers.

Also it is known to apply a corrosion inhibiting composition, comprising specific reaction products like the product 6[2,4-bis(allylamino)-s-triazin-6-ylamino]-2-mercaptobenzothiazole as disclosed in Example 10(B) of EP 331279 A2 to brass coated steel cord.

Further, in general, DD 118,668 A discloses corrosion inhibiting compositions comprising a carrier oil having a boiling point in the range of 100–450° C. and a mixture of corrosion inhibitors soluble or solubilized in the carrier oil. Examples of suitable corrosion inhibitors are a.o.t. benzotriazole, methylbenzotriazole and sodium benzoate. In particular the corrosion inhibitors are selected in such a way that a synergistic activity is achieved. Preferred corrosion inhibitors providing both a synergistic activity and a viscosity elevating activity are metal salts of higher fatty acids, in particular stearic acid like aluminium stearate. Other preferred corrosion inhibitors are oleyl sarcosine and its amine and alkaline salts.

RU 2,009, 188 C (Derwent publication AN 94-284337) relates to a conservation-lubricant for e.g. lead-coated steel based on an emulsifier, containing mineral oil, polyethylene glycol ether of stearic acid with 6 moles of ethylene oxide, the product of oxyethylation of octadecyl alcohol with 20 moles of ethylene oxide, and the triethanolamine soap of 10–20 C synthetic fatty acids. For improving the results, the lubricant additionally contains mineral oil, benzotriazole and cobalt naphthenate.

JP 49 021 299 B (Derwent publication AN 74-47967V) discloses a corrosion inhibiting composition comprising a mineral oil, an organic salt of a higher fatty acid amine and optionally benzotriazole. Such a composition provides a corrosion protecting activity to steel cord and may apparently prevent reduction of adhesive forces between steel cord and rubber as well as reduction of sticking rate of rubber to steel cord under highly humid atmosphere.

U.S. Pat. No. 5,156,759 A refers to a lubricating composition having particular utility in gas compressors, which composition is rust-inhibited and oxidation stable and provides good lubricity at high temperature in the absence of sulfur, phosphorous and metals such as zinc (column 1, lines 43–46). More in particular the lubricating composition comprises a major proportion of a synthetic base lubricating oil, an additive solubilizer, an phenolic or amino antioxidant and a rust inhibitor/metal passivator selected from the group consisting of triazolc and alkenyl succinic acid ester rust inhibitors.

In Patent Abstracts of Japan, Vol. 015, No. 133 (JP 03 017 191 A) a corrosion inhibiting grease, i.e. not a free-flowing product at 40° C., is disclosed, comprising a mixed base oil containing (A) a specific polyoxypropylene glycol monoalkyl ether and a specific alkyl substituted disphenyl ether, (B) a higher fatty acid lithium salt and (C) a metal-inactivating agent such as benzotriazole.

GB- 1,364,781 A discloses a process for improving the adhesion of steel cord to rubber after vulcanisation thereof. According to this process the steel cord—prior to its use as reinforcing means in the rubber—is treated by dipping it in a mineral oil solution containing an organic acid salt of an aliphatic amine, containing from 12 to 22 carbon atoms. Examples of such organic salts are cocoa-nut monoamine salicylic acid salt, coconut monoamine acetic acid salt and beef tallow diamine salicylic salt. Further the mineral oil may contain further ingredients conventionally used to prevent discoloration of copper alloys, for example benzotriazole.

Further U.S. Pat. No. 2,890,170 relates to organosiloxane greases, i.e. not a free-flowing product at 40° C., which provide an improved metal corrosion resistance. Such greases comprise a small amount of benzotriazole and—if desired—a small amount of an anhydride of a.o.t. an alkyl succinic or alkenyl succinic acid, totally containing 8–23 carbon atoms.

As apparent from the above it is known from the prior art to apply corrosion inhibiting compositions to steel articles, in particular steel cord resulting in an improved corrosion resistance of the treated steel cord. However, such an improvement of the corrosion resistance may—after vulcanisation of the rubber—result in a considerable loss of the adherence between the steel cord and the rubber comprising the steel cord as reinforcing means.

In view of the above the invention is directed to a method for avoiding above disadvantage, i.e. to the development of a corrosion inhibiting composition which decreases the level of corrosion of the steel cord and hardly affects the adherence between the steel cord and rubber after vulcanisation thereof. Further the invention should particularly relate to compositions which are environmentally acceptable.

SUMMARY OF THE INVENTION

The above aim is achieved by means of a corrosion inhibiting composition, characterized in that it comprises A) a carrier of an oily or waxy type, and B) active components comprising at least B1) a corrosion-inhibitor of the azole-type; and B2) a co-corrosion-inhibitor, selected from the group consisting of (a) aromatic acids and naphthenic acids, which acids have the free acid form or the alkaline, alkaline earth, ammonium and/or amine salt form with the proviso that sodium benzoate is excluded;

(b) imidazoline derivatives having an $C_{6-24}$ alkyl moiety; and (c) $C_{6-24}$ alkyl succinic and alkenyl succinic acids including anhydride compounds thereof;

as well as mixtures of compounds defined under (a), (b) and (c); and

C) optionally a compound selected from the group consisting of

C1) a water-repellent;

C2) a synthetic system derived from a $C_{1-10}$ alcohol with 1–12 hydroxyl groups and $C_{6-24}$ fatty acids; and C3) a $C_{6-18}$ alcohol as well as a mixture of compounds defined under C1, C2 and/or C3.

The compositions according to the invention are suitable for protecting steel wire or steel cord composed of several steel filaments from corrosion.

The steel cord may be covered by a metal or plastic coating which, however, do not coat the steel cord completely.

In case of steel cord the benefits of using the compositions according to the invention may be summarized as follows:

(a) the compositions impart steel cord, treated with these compositions, with adequate resistance against corrosion, (b) the compositions impede adhesion of rubber to steel cord, treated with these compositions, after embedding said steel cord in rubber and subsequent vulcanising, to an acceptable level. The compositions do hardly interfere with the delicate physicochemical processes which anchors steel cord to rubber during vulcanisation; and (c) after vulcanisation of rubber in which steel cord is embedded, the compositions according to the invention continue to impart to steel cord some degree of corrosion resistance.

In view of the above the invention is directed to the steel cord, treated with the composition according to the invention.

Another object of the invention relates to a process for manufacturing a corrosion resistant elongated steel object comprising the following steps:

(a) covering the steel cord with a coating layer having an electrode potential exceeding the electrode potential of steel or having a rate of corrosion, which is less than the rate of corrosion of steel;

(b) drawing the steel cord up to the final diameter; and (c) at least partly covering the steel cord with a corrosion inhibiting composition according to the invention.

A further object of the invention relates to rubber articles, provided with reinforcing means, like steel cord, treated with the composition according to the invention. Such reinforced rubber articles are for instance power transmission belts, conveyor belts, rubber hoses and tires of any type.

DESCRIPTION OF THE PREFERRED EMBODIMENTS (A) The Compositions

The components of the composition according to the invention can be elucidated by the following detailed description.

Carrier

The corrosion inhibiting compositions or corrosion preventives according to the invention typically contain one or more carriers. They are to be considered as the carriers of the active additives and more specifically the corrosion inhibitors. To a certain extent the carrier itself may have corrosion preventing properties, especially due to its hydrophobic character. Carriers may be of mineral, animal, vegetable or synthetic origin. By mixing non-polar with more polar compounds the solubility characteristics can be adjusted to allow the additives to be solubilized.

Carriers of mineral origin include mineral oils and waxes. Examples of mineral carriers useful in the invention include naphthenic and paraffinic oils and waxes. Mineral oils and waxes are commercially available from Exxon, Shell, and Sun oil companies.

Carriers of animal origin include natural fats and oils such as lard oil, sperm oil, and tallow. Renderings from meat and fish production are primary sources of such animal based lubricants.

Carriers of vegetable origin include cottonseed oil, corn oil, castor oil, rapeseed oil and tall oil. These oils may be produced directly, or may result as a byproduct of other processes such as the pulping of wood.

Carriers of synthetic origin include esters such as polyol esters. Typical synthetic esters which may serve as co-carriers of the present invention are inter alia described in U.S. Pat. No. 3,526,596, and comprise the esters of fatty acids where the alcohol has 1 to 12 hydroxyl groups and the fatty acid has 6 to 24 carbon atoms. Other representative synthetic ester lubricants are described in U.S. Pat. No. 3,681,440 (the esters of organic monocarboxylic acids and dineoalkyl ethers with a tetrahydroxy functionality), U.S. Pat. No. 4,178,261 (esters incorporating 6-cyclohexylhexanoic acid and a polyhydric alcohol), U.S. Pat. No. 4,871,476 (esters of cyclohexanol or cyclohexanecarboxylic acid in combination with 1% to 70% by weight of a branched poly-a-olefin), U.S. Pat. No. 4,786,427 (diesters formed from dicarboxylic acids and monohydric compounds), U.S. Pat. No. 4,978,468 (cyclohexyl esters in combination with from 0.1 to 95% by weight of a polymer selected from hydrocarbonic polymers and polyesters).

Other synthetic carriers useful for the present invention include polyolefin oils (synthetic hydrocarbon oils), polyether oils including polyoxyalkylene glycols, polyalkylene oxide-ester oils, hydrocarbon polymers, and mono- or polyhydric alcohols having at least 5 carbon atoms.

Corrosion inhibitors

A typical corrosion inhibitor is selected from the families of the azoles. Illustrative azole-type corrosion inhibitors are benzotriazole, tolutriazole, the sodium salt of mercaptobenzotriazole, naphthotriazole, methylene bisbenzotriazole, dodecyltriazole and butylbenzotriazole, preferably tolutriazole. A suitable, commercially available form of benzotriazole which may be used in the invention is CORBRATEC®, marketed by PMC Specialties Group, Inc. (Rockey River, Ohio). Other non-ferrous corrosion inhibitors suitable to be used in the composition according to the invention will be readily apparent to an average skilled artisan.

Co-corrosion inhibitors

A class of compounds incorporated into the composition according to the invention, and serving to enhance the corrosion preventing properties of the composition are the aromatic acids and naphthenic acids and salts thereof.

Aromatic acids include benzoic acid compounds substituted by one or more hydrophobic groups like $C_{6-24}$ alkyl groups. Further the aromatic acids may also have the alkaline, i.e. Li, Na, K, alkaline-earth i.e. Ca, Mg, Ba, Sr, ammonium and amine i.e. $C_{1-6}$ alkylamine and $C_{1-6}$ alkanolamine salt form. Examples of amines are TEA, MEA, DEA, AMP, butylamine and hexylamine.

Naphthenic acids are marketed products having the CAS Registry Number 64754-89-8 and 1338-24-5. More in particular naphthenic acids represent a complex combination of compounds. These acids contain carboxylic acid functional groups and five- to six-member naphthenic rings in their molecular structure. Preferably the naphthenic acid is a naphthenic-13 acid used in the salt form like alkaline, alkaline-earth, ammonium and amine salt forms as indicated above, most preferably in the barium salt form.

Another class of compounds which also may be incorporated into the composition according to the invention, and which serve to enhance the corrosion preventing properties of the composition are imidazolines, having a $C_{6-24}$ alkyl moiety. For instance imidazoline phosphate esters having a $C_{6-24}$ alkyl group may be used. More in particular the imidazoline phosphate esters are represented by the formula $$[(R—O—(C_2H_5—O)_n)_m—(P=O—(OH)_{3-m}].[C_3H_5N_2]_{3-m}$$

in which n ranges from 1 to 20, m ranges from 1 to 2 and R is an alkyl or alkenyl group having from 6 to 24 carbon atoms. Preferably n is smaller than or equal to 10. Preferably R is an alkyl or alkenyl group having 10 to 16 carbon atoms. Examples of suitable alkyl and alkenyl groups include undecyl, dodecyl, tridecyl, decenyl, tridecenyl, tetrapropenyl and tetradecenyl.

Still another class of compounds which may be incorporated into the composition of the invention, and which serve to enhance the corrosion preventing properties of the composition are $C_{6-24}$ alkyl or alkenyl succinic anhydrides. More in particular the alkyl and alkenyl succinic anhydrides are represented by the formula

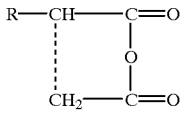

in which R is an alkyl or alkenyl group having 6 to 24 carbon atoms. Preferably R is an alkyl or alkenyl group having 10 to 16 carbon atoms. Examples of suitable alkyl or alkenyl groups include undecyl, dodecyl, tridecyl, decenyl, dodecenyl, tetradecenyl and hexadecenyl.

Water repellants

Water repellants can be part of the composition to support the action of the corrosion inhibitors by preventing the presence of water at the steel/rubber interface. Suitable water repellants are $C_{1-5}$ alcohols and $C_{1-5}$ alkylglycols, preferably butyldiethyleneglycol (=2-(butoxy-ethoxy) ethanol), having the CAS-number 112-34-5.

Synthetic esters

Synthetic esters are applied for providing a good corrosion inhibition rating but more in particular for decreasing the adherence loss rating to a minimum. These synthetic esters are derived from $C_{1-10}$ alcohols with 1–12 hydroxyl groups and $C_{6-24}$ fatty acids. Examples of such esters are the esters of neopentylglycol and $C_{8-18}$ technical fatty acids and the esters of neopentylglycol and cocos fatty acids.

$C_{6-18}$ alcohols $C_{6-18}$ alcohols are also applied for providing a good corrosion inhibition rating and a minimal adherence loss rating. Preferably technical alcohol mixtures like $C_{12-13}$ technical alcohol are used.

The composition according to the invention may contain further additives. Examples thereof are mentioned below.

Stabilizers

Stabilizers might be needed to impart sufficient storage stability of the composition according to the invention. Some components have limited solubility in the carrier which may result in separation of these components from the composition during storage or use. Esters and natural or synthetic fatty alcohols may be applied to overcome this.

Anti-oxidants

The composition according to the invention may also contain one or more antioxidants for improving the storage life of the compositions. Suitable aromatic amine antioxidants include phenothiazine, iminodibenzyl, diphenylamine, phenyl-α-naphthylamine and phenyl-α-naphthylamine and phenyl-β-naphthylamine. Particularly suited are the alkylated aromatic amines.

When an antioxidant is present in the composition, the antioxidant preferably ranges up to about 0.5% of the total weight of the composition. More preferably the antioxidant is present in an amount of about 0.1 to about 0.3%.

Further the viscosity of the composition according to the invention is at most 600 cSt, advantageously less than 40 cSt, preferably less than 30 cSt and most preferably less than 20 cSt, determined at 40° C.

Finally it is brought to the fore that the percentage of the carrier, present in the composition according to the invention may range between wide limits like 65–95% calculated on the total weight of the composition. Concerning the other components of the composition according to the invention it is remarked that the mutual percentages may also range between wide limits. For instance the percentage of the corrosion inhibitor is 0.05–5%, the percentage of the co-corrosion-inhibitor is 4.9–20%, the percentage of the water-repellant is 0.05–5%, the percentage of the synthetic ester is 0–20%, preferably 5–15%, and the percentage of the $C_{6-18}$ alcohol is 0–15%, preferably 4–11% calculated on the total weight of the composition.

BRIEF DESCRIPTION OF THE DRAWINGS

The invention will be elucidated by means of the following two figures.

(C) APPLICATION OF THE COMPOSITION ON STEEL CORD AND THE MEASUREMENT OF THE RELEVANT PROPERTIES.

A steel cord used in the process according to the invention is manufactured as follows.

Starting from a marketed rod wire, the wire is drawn in several phases until an intermediate diameter is reached. After reaching the intermediate diameter the wire is electrolytically coated with copper and subsequently with zinc, after which a thermofusion occurs resulting in a brass coating around the wire. Typically the brass coating has a copper content between 60 and 70% by weight. The wire, having the intermediate diameter is normally completely coated with the brass coating layer. Then the wire having the intermediate diameter is drawn to a smaller final diameter, normally by means of wet-drawing machines. During the wet-drawing the brass coating layer becomes successively porous: the coating layer becomes thinner and thinner and shows local cracks where the steel comes to the surface.

The porosity may be expressed in a quantitative way as the percentage of iron coming to the surface next to the brass coating layer, and can be determined according to Notter I. M., Gabe D. R. and Warwick M. E., "Polarization resistance methods for measurement of the porosity of tin coatings on steel", Trans. IMF 1986, 64, 105–109, and according to Notter I. M. and Gabe D. R., "Porosity of electrodeposited coatings: its cause, nature, effect and management", Corr.Rev. 10, 1992 3/4, 217–280. Porosity values of hard drawn steel cords may vary between 2 and 25%, for instance between 3 and 20%.

Figure 1:
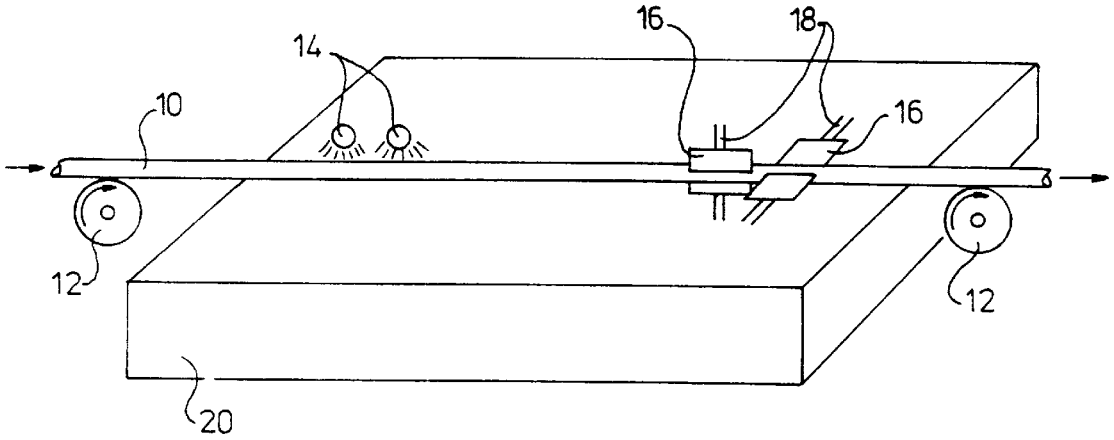
FIG. 1 illustrates a schematic view of the method according to which the corrosion inhibiting composition according to the invention is applied on a steel filament.

Subsequently the wire, having its final diameter, is covered with the corrosion inhibiting composition according to the invention, as illustrated in FIG. 1. Wire 10 follows a straight path over guiding wheels 12. From one or more tubes 14 which are provided with holes the corrosion inhibiting composition is dripped on the wire. Somewhat further, downstream, the excess of corrosion inhibiting composition is removed by means of for instance a felt material 16, which is pressed at several sides against wire 10 by means of rods 18. The felt material 16 may be saturated with the corrosion inhibiting composition. After the wiping action by the felts the wire can be dried in a furnace. Recuperation of the corrosion inhibiting composition which drips from the wire 10 or from the felt material 16 may occur by using a recuperation bath 20. Then several wires are twined to a steel cord. Finally the steel cord is wound on a coil for storage and transportation purposes.

The covering with the corrosion inhibiting composition according to the invention may also be done after having twisted the wired to a steel cord.

The corrosion behaviour of steel cord covered with a corrosion inhibiting composition according to the invention is simulated and determined according to the standard procedure: "Corrosion tests and standards: application and interpretation, ASTM MNL 20, pp. 86–88, ASTM G3-89, ASTM G5-82, ASTM G15-85a and ASTM STP 727 and by means of the so-called gel test, which has been described in EP-A 0 290 086. In this gel test the steel cord is used as working electrode in an electrochemical cell comprising reference electrodes. An electric current having changing frequencies is applied to the electrochemical cell and per applied frequency the amplitude and phase of the resulting electric voltage is determined.

Figure 2:
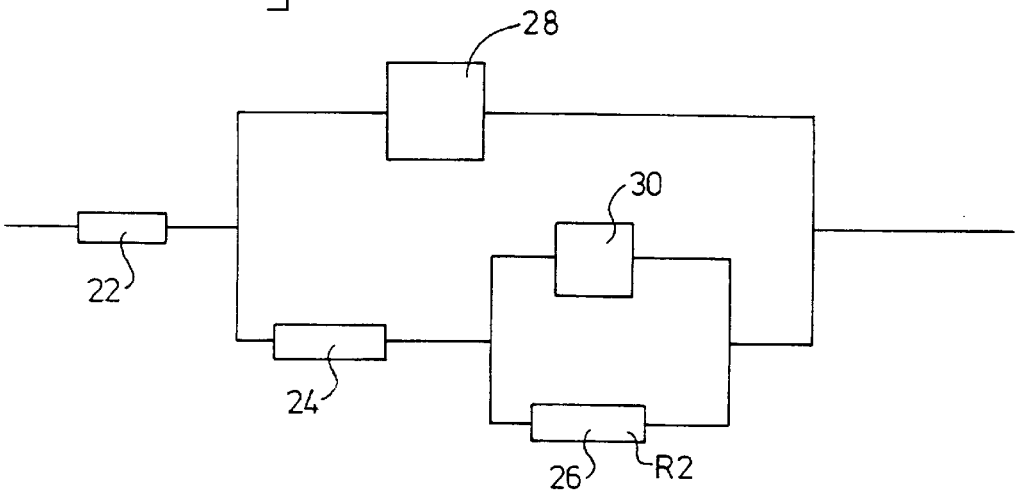
FIG. 2 illustrates an electric equivalent circuit, applied for corrosion studies.

For analysis of the dynamic corrosion behaviour the electric equivalent circuit according to FIG. 2 is used. In this figure the elements 22, 24 and 26 represent electric resistors (impedance values having only a real part) and elements 28 and 30 represent elements having a constant phase.

The major value in this equivalent circuit is the value of the electric resistor 26 ($R_2$). The higher the value of this resistor, the longer the corrosion resistance of the tested steel cord. Another parameter, next to the value of the electric resistor 26, which is used for the determination of the corrosion resistance, is the so-called "inhibition rating" as defined in "Compendium of Chemical Terminology", IUPAC Recommendations, Blackwell Scientific Publications, 1987, p. 198:

$$I=(V_o-V)/V_o$$

wherein

I represents the rate of corrosion inhibition (in percent);

$V_o$ represents the corrosion rate of a non-treated steel cord with $V_o=1/R_2$ V represents the corrosion rate of a treated steel cord with $V=1/R_2$ $R_2$ is the resistance value of the electric resistor 22.

The other important property, i.e. the adherence between rubber and a steel cord treated according to the invention is determined as follows. A non-treated steel cord, together with a treated steel cord is embedded in an industrial rubber composition which is subsequently vulcanised. Both steel cords are pulled out from the vulcanised rubber and the forces necessary therefore are measured and compared, resulting in the "adherence loss rating". Such a test has been carried out according to ASTM—No. D 2229 (-93) ("Standard test Method for adhesion between steel tire cords and rubber") and according to BISFA (The International Bureau for the standardization of man-made fibres) No. E12 ("Determination of static adhesion to rubber compound").

With respect to the above defined ratings the following ranges are given:

corrosion inhibition rating: >60% good 50–60% good to moderate <50% moderate to poor adherence loss rating: <4% good 4–6% good to moderate 6–10% moderate >10% poor.

The invention is illustrated by the following examples but is not in any way limited thereto. If not indicated otherwise the % in the composition are wt. %.

EXAMPLE 1

A steel cord is manufactured and treated in the above-defined way with a corrosion inhibiting composition according to the invention composed of the following components:

Mineral seal oil: 88.7%

Naphthenic Acid 13, Barium soap: 9.8%

Butyldiethyleneglycol: 1.3%

Tolutriazole: 0.2%

Total:100%

Further physical properties of said composition are:

viscosity at 40° C.: 7.0 $mm^2/s$ (Cannon Fenske normal) (=7.0 cSt)

density at 20° C.: 0.868 $g/cm^3$ boiling point: above 100° C.

melting point: below 4° C.

flash point: 131° C. (according to the Cleveland open cup method)

not soluble in water oily film type

The following table illustrates the results for the corrosion resistance, i.e. the corrosion inhibition rating and the adherence with the rubber, based on an industrial rubber composition.

| | $R_2$ after 1.5 hours (ohm) | $R_2$ after 20 hours (ohm) | I after 1.5 hours (%) | I after 20 hours (%) | adherence loss rating (%) |
|---|---|---|---|---|---|
| non-treated steel cord | 2026 | 1683 | | | |
| steel cord treated according to the invention not embedded in rubber | 8781 | 4642 | 77 | 64 | |
| non-treated steel cord embedded in rubber | | | | | 0 |
| treated steel cord embedded in rubber | | | | | 8.7 |

As derivable from the above table a steel cord treated according to the invention shows a considerable improvement for the corrosion resistance without a substantial loss of adherence.

Further to the results illustrated in the above table, it is determined that the value of resistor $R_2$ of the steel cord treated according to the invention and embedded in rubber does rise, compared to a non-treated steel cord embedded in rubber. This means that not only the corrosion resistance of the steel cord treated according to the invention is higher during storage and transport but also after vulcanisation in the rubber.

EXAMPLE 2

Mineral seal oil: 72.9%

Ester of neopentyl glycol and cocos fatty acids: 10.0%

Naphthenic Acid 13, Barium Soap: 9.8%

C12–13 technical alcohol: 5.0%

Butyldiethyleneglycol: 1.3%

Tolutriazole: 0.16%

Alkylated diphenol: 0.13%

Sulphurized DTBP: 0.33%

Octyl diphenylamine: 0.33%

Total:100%

Viscosity at 40° C.: 7.0 cSt

Corrosion inhibition rating, if compared with non-treated reference: +35% Adherence loss rating, if compared with non-treated reference: 4.9%

EXAMPLE 3

In this example a series is shown in which a certain range of concentration of synthetic ester/alcohol minimises the adherence loss. This synergy cannot be expected from the state of the art. On the other hand, corrosion inhibition decreases with increasing ester/alcohol concentration. Hence the preferred composition B is a compromise.

A. Low ester/alcohol content

Mineral seal oil: 78.5%

Naphthenic acid, Ba salt: 10.0%

Tolutriazole: 0.2%

Synthetic ester*: 5.0%

C12–13 Technical alcohol: 5.0%

Butyldiethyleneglycol: 1.3%

Viscosity at 40° C.: 6.2 cSt

Corrosion inhibition rating, if compared with non-treated reference: 70% Adherence loss rating, if compared with non-treated reference: 2%

B. Preferred composition—minimal adherence loss

Mineral seal oil: 73.5%

Naphthenic acid, Ba salt: 10.0%

Tolutriazole: 0.2%

Synthetic ester*: 10.0%

C12–13 Technical alcohol: 5.0%

Butyldiethyleneglycol: 1.3%

Viscosity at 40° C.: 6.7 cSt

Corrosion inhibition rating, if compared with non-treated reference: 62% Adherence loss rating, if compared with non-treated reference: <1%

C. High amount of ester/alcohol

Mineral seal oil: 68.5%

Naphthenic acid, Ba salt: 10.0%

Tolutriazole: 0.2%

Synthetic ester*: 15.0%

C12–13 Technical alcohol: 5.0%

Butyldiethyleneglycol: 1.3%

Viscosity at 40° C.: 6.3 cSt

Corrosion inhibition rating, if compared with non-treated reference: 59% Adherence loss rating, if compared with non-treated reference: 4%

* Synthetic ester: ester of neopentylglycol and C8–18 technical fatty acids (=cocos fatty acids).

EXAMPLE 4

Mineral seal oil: 93.0%

Imidazoline phosphate $C_{13}$ alkylester: 2.5%

Tolutriazole: 0.5%

C12 succinic anhydride: 1.0%

C12–13 technical alcohol: 3.0%

Viscosity at 40° C.: 24.5 cSt

Corrosion inhibition rating, if compared with non-treated reference: 55% Adherence loss rating, if compared with non-treated reference: 5%

COMPARATIVE EXAMPLE 1—(No Corrosion Inhibitor of the Azole Type)

Mineral seal oil: 78.4%

Naphthenic Acid 13, Barium soap: 9.8%

Butyldiethyleneglycol: 1.3%

Barium sulphonate (corrosion inhibitor): 10.5%

Total: 100%

Viscosity at 40° C.: 7.0 cSt

Corrosion inhibition rating, if compared with non-treated reference: +46% Adherence loss rating, if compared with non-treated reference: 47%

COMPARATIVE EXAMPLE 2—(No Corrosion Inhibitor)

Mineral seal oil: 88.9%

Naphthenic Acid 13, barium soap: 9.8%

Butyldiethyleneglycol: 1.3%

Total: 100%

Viscosity at 40° C.: 6.0 cSt

Corrosion inhibition rating, if compared with non-treated reference: −55% Adherence loss rating, if compared with non-treated reference: 2%

COMPARATIVE EXAMPLE 3—(No Corrosion Inhibitor and No Co-Corrosion Inhibitor)

Mineral seal oil: 100%

Total: 100%

Viscosity: 4.5 cSt

Corrosion inhibition rating, if compared with non-treated reference: −15% Adherence loss rating, if compared with non-treated reference: 16%.

What is claimed is:

1. A steel cord covered with a coating layer having an electrode potential exceeding the electrode potential of steel or having a rate of corrosion which is lower than the rate of corrosion of steel, treated with a corrosion inhibiting composition, wherein said composition comprises:

A) a carrier of an oil or wax, and

B) active components comprising

B1) a corrosion-inhibitor in the azole family;

B2) a co-corrosion-inhibitor, selected from the group consisting of a) aromatic acids and naphthenic acids, which acids have the free acid form or the alkaline, alkaline earth, ammonium and/or amine salt form with the proviso that sodium benzoate is excluded;

b) imidazoline derivatives having a $C_{6-24}$ alkyl moiety;

c) $C_{6-24}$ alkyl and alkenyl succinic acids including the anhydride compounds thereof; and mixtures of compounds defined under (a), (b) and (c).

2. A steel cord according to claim 1, wherein the carrier in said composition is selected from oils and waxes of mineral, animal, vegetable and synthetic origin.

3. A steel cord according to claim 2, wherein the carrier in said composition is of synthetic origin.

4. A steel cord according to claim 3, wherein the carrier in said composition is mineral seal oil.

5. A steel cord according to claim 1, wherein the corrosion-inhibitor in the azole family in said composition is an aromatic triazole compound.

6. A steel cord according to claim 5, wherein the corrosion-inhibitor in the azole family in said composition is tolutriazole.

7. A steel cord according to claim 1, wherein the aromatic acids are benzoic acid substituted by one or more $C_{6-24}$ alkyl groups.

8. A steel cord according to claim 7, wherein the aromatic acids have the salt form selected from the group consisting of alkaline metal, alkaline earth metal, ammonium and amine salts.

9. A steel cord according to claim 1, wherein the naphthenic acids have the salt form selected from the group consisting of alkaline metal, alkaline earth metal, ammonium and amine salts.

10. A steel cord according to claim 9, wherein the naphthenic acid salt is a naphthenic-13-barium salt.

11. A steel cord according to claim 1, wherein the imidazoline derivatives are selected from the group consisting of imidazoline phosphate esters having a $C_{6-24}$ alkyl group.

12. A steel cord according to claim 1, wherein the $C_{6-24}$ alkyl succinic anhydride is selected from the group consisting of undecyl, dodecyl and tridecyl succinic anhydride and mixtures thereof.

13. A steel cord according to claim 1, wherein the percentage of the carrier is 65–95% calculated on the total weight of the composition.

14. A steel cord according to claim 1, wherein the coating layer is a metallic layer.

15. A steel cord according to claim 1, wherein the steel cord is partly covered with the coating layer.

16. A steel cord according to claim 15, wherein about 2–25% of the steel cord is not covered with the coating layer.

17. A steel cord according to claim 1, further including at least one compound selected from the group consisting of:

C1) a water repellant;

C2) a synthetic ester derived from a $C_{1-10}$ alcohol with 1–12 hydroxyl groups and $C_{6-24}$ fatty acids;

C3) a $C_{6-18}$ alcohol; and mixtures of compounds defined under C1, C2 or C3.

18. A steel cord according to claim 17, wherein the water-repellant is selected from $C_{1-5}$ alcohols and $C_{1-5}$ alkylglycols.

19. A steel cord according to claim 18, wherein the water-repellant is butyldiethyleneglycol.

20. A steel cord according to claim 17, wherein the synthetic ester in said composition is the ester of neopentyl glycol and cocos fatty acids.

21. A steel cord according to claim 17, wherein the synthetic ester in said composition is the ester of neopentyl glycol and $C_{8-18}$ technical fatty acids.

22. A steel cord according to claim 17, wherein the $C_{6-18}$ alcohol in said composition is a $C_{12-13}$ technical alcohol.

23. A steel cord according to claim 17, wherein:

the percentage of the corrosion-inhibitor in said composition is 0.05–5%, the percentage of the co-corrosion-inhibitor in said composition is 4.9–20%, the percentage of the synthetic ester is 0–20% the percentage of the $C_{6-18}$ alcohol is 0–15% and the percentage of the water-repellant in said composition is 0–5%, calculated on the total weight of the composition.

* * * * *

UNITED STATES PATENT AND TRADEMARK OFFICE

CERTIFICATE OF CORRECTION

PATENT NO. : 6,068,918

DATED : May 30, 2000

INVENTOR(S) : Jan Marcel Van Der Veer et al.

It is certified that error appears in the above-identified patent and that said Letters Patent is hereby corrected as shown below:

On the Title Page, refer to [73] Assignee, "Bekhaert" should read --Bekaert--.

On the Title Page, refer to [56] References Cited, under OTHER PUBLICATIONS, first reference, second line, "measurement" should read --measurements--.

Column 1 Line 7 "steelcord" should read --steel cord--.

Column 2 Line 1 "RU 2,009, 188" should read --RU 2,009,188--.

Column 2 Line 30 "triazolc" should read --triazole--.

Column 7 Line 17 after "filament;" insert --and--.

Column 8 Line 9 "wired" should read --wire--.

Column 8 Line 56 "therefore" should read --therefor--.

Column 13 Line 6, Claim 23, after "0-20%" insert comma --,--.

Column 14 Line 1, Claim 23, after "0-15%" insert comma --,--.

Signed and Sealed this

Tenth Day of April, 2001

*Attest:*

Nicholas P. Godici

NICHOLAS P. GODICI

*Attesting Officer*

*Acting Director of the United States Patent and Trademark Office*